United States Patent [19]

Osborn

[11] Patent Number: 4,750,230

[45] **Date of Patent: * Jun. 14, 1988**

[54] GOLF CLUB GRIP CLEANER

[76] Inventor: Jack S. Osborn, P.O. Box 700245, Tulsa, Okla. 74170

[ * ] Notice: The portion of the term of this patent subsequent to Jun. 30, 2004 has been disclaimed.

[21] Appl. No.: 52,973

[22] Filed: May 22, 1987

Related U.S. Application Data

[63] Continuation-in-part of Ser. No. 905,561, Sep. 10, 1986, Pat. No. 4,676,839.

[51] Int. Cl.[4] ..... A46B 13/04

[52] U.S. Cl. ..... 15/21 D; 15/97 R; 15/104.04

[58] Field of Search ..... 134/25.1, 25.4, 18; 15/21 C, 21 D, 21 E, 21 R, 76, 104.04, 104.92, 65, 67, 69, 75, 76, 88, 97 R

[56] References Cited

U.S. PATENT DOCUMENTS

| | | | |
|---|---|---|---|
| 3,148,396 | 9/1964 | Smith | 15/21 D |
| 3,224,209 | 12/1965 | Domingos | 15/104.92 |
| 3,332,099 | 7/1967 | Reiter | 15/21 R |
| 3,372,534 | 3/1975 | Hoag | 15/21 D |
| 3,619,841 | 11/1971 | Russell et al. | 15/21 D |
| 4,069,536 | 1/1978 | Hartz et al. | 15/104.92 |
| 4,380,839 | 4/1983 | Caradonna | 15/104.92 |
| 4,472,851 | 9/1984 | Kinsey | 15/21 D |
| 4,554,696 | 11/1985 | Nye, Jr. | 15/21 D |

*Primary Examiner*—Edward L. Roberts
*Attorney, Agent, or Firm*—Robert B. Stevenson

[57] ABSTRACT

An electrically powered automated golf club grip cleaning unit for sequentially cleaning a full set of golf clubs essentially as fast as the operator can insert and withdraw the clubs from the unit. The automated unit comprises a closed, water tight housing that is divided into an upper and a lower compartment having a rotating (carousel-like) lid that accepts a plurality of inverted golf club shafts and grips through openings into the top compartment and allows the clubs to spin while advancing them through a wash and rinse zone while making abrasive contact with spinning brushes within the upper compartment and simultaneously recycling wash water as well as rinse water accumulating in partitioned reservoirs in the lower compartment back to the upper compartment for cleaning the grips of the golf clubs. The apparatus further provides continuous bleed-off of some of the recirculating rinse water and make up of fresh water.

3 Claims, 7 Drawing Sheets

GOLF CLUB GRIP CLEANER

CROSS-REFERENCE TO RELATED APPLICATION

This application is a continuation-in-part of U.S. application Ser. No. 905,561 filed Sept. 10, 1986, now U.S. Pat. No. 4,676,839 issued June 30, 1987.

BACKGROUND OF THE INVENTION

1. Field of the Invention

This invention relates to an apparatus and method for automatically cleaning the hand grip on a tubular member such as used in athletic equipment, hand tools or the like. More specifically, the invention relates to an apparatus that sequentially and continuously cleans the hand grips on a set of golf clubs.

2. Description of the Prior Art

The basic concept of employing a set of revolving brushes in combination with a wash water stream and a rinse water stream to clean an object is generally known and commercially practiced in applications that vary broadly from such uses as automatic car washes to production lines that reuse glass containers. However, such concepts and washing techniques have found only limited applications when applied to the cleaning of the gripping surface on handles of such items as golf clubs. For example, U.S. Pat. Nos. 3,224,029 and 4,554,696 disclose devices that are intended to clean the hand grip on a single golf club, but neither of these devices are capable of simultaneously cleaning several golf clubs. As such, the devices are slow and not amenable to cleaning an entire set of golf clubs in a convenient time span consistent with the demand occurring at a golf club and during play. As such, prior to the present invention, there remains a need for an apparatus and method of automatically cleaning multiple golf club grips of an entire set of clubs on a short time span basis.

SUMMARY OF THE INVENTION

In view of the problems associated with cleaning the hand grips of a set of golf clubs, the present invention provides an automatic apparatus and automatic method of cleaning and rinsing golf club grips or the like. The apparatus and method are distinguishable from the prior art in that multiple clubs can be simultaneously proceeding through the wash and rinse cycles at a rate that is basically limited only by the operator's ability to insert and withdraw the individual clubs. As such, the device is compatible with cleaning an entire set of clubs prior to or immediately after playing a game of golf or even during the play of the game itself.

Thus, the present invention provides an apparatus for cleaning a continuous sequence of golf club grips comprising:

(a) an essentially water tight, external housing member having an open top and an upper and lower compartment therein, wherein the upper compartment is partitioned into a golf club grip washing zone, a golf club grip rinse zone and a zone for insertion and removal of golf club grip and shaft and wherein the lower compartment is partitioned into a wash water reservoir and a rinse water reservoir;

(b) a rotatable, golf club positioning and advancing means for holding the golf club grips and shafts of a plurality of inverted golf clubs inserted through a plurality of openings in the top of the golf club positioning and advancing means, within the upper compartment and for advancing golf club grips and shafts from the zone for insertion and removal sequentially through the wash zone and the rinse zone and back to the zone for insertion and removal;

(c) a rotatable, golf club spinning means adapted to be positioned between the upper and lower compartments of the external housing member and rotate with the rotatable, golf club positioning and advancing means and for receiving and holding tips of inverted golf club grips and shafts and for allowing golf club grip and shaft being held within the upper compartment to spin by virtue of contact with rotatable scrubbing means as golf club grips and shafts advance through the wash zone and the rinse zone;

(d) a plurality of essentially rotatable scrubbing means positioned within the upper compartment of the external housing member and adapted to make scrubbing contact with golf club grips as they advance from the insertion and removal zone through the wash zone and the rinse zone back to the insertion and removal zone;

(e) A motor powered means for driving the rotatable, golf club positioning and advancing means;

(f) a recirculating pump and fluid delivery means for withdrawing wash water from the wash water reservoir and delivering it to the wash zone; and (g) a recirculating pump and fluid delivery means for withdrawing rinse water from the rinse water reservoir and delivering it to the rinse zone.

It is an object of the present invention to provide a golf club cleaning apparatus that will accept a continuous sequence of golf clubs manually inserted into the apparatus and continuously and automatically advance the golf club grip through a wash and rinse cycle within the apparatus prior to manually withdrawing the cleaned golf club. It is a further object of the present invention to provide such a device that can operate sequentially as fast as the operator can insert and withdraw golf clubs, thus lending the overall operation to cleaning an entire set of golf clubs during the play of the game or the like. Fulfillment of these objects and the presence and fulfillment of additional objects will become apparent upon complete reading of the specification and claims taken in conjunction with the attached drawings.

DESCRIPTION OF THE PREFERRED EMBODIMENTS

The golf club grip cleaning apparatus and associated method according to the present invention, how it functions and how it differs from the prior art, and the advantages associated with its use can perhaps be best explained and understood by reference to the drawings. FIGS. 1 through 8 illustrate one particularly preferred embodiment of the golf club grip cleaner according to the present invention. As illutrated, the invention is being described in terms of cleaning golf club grip handles; however, the invention is viewed as being broadly applicable to any other hand grip that is compatible with soap and water scrubbing (i.e., any tool, sporting good equipment of the like having a rubber grip attached to the end of an essentially straight handle) and as such, the description should not be viewed as being unduly limiting.

Figure 2:
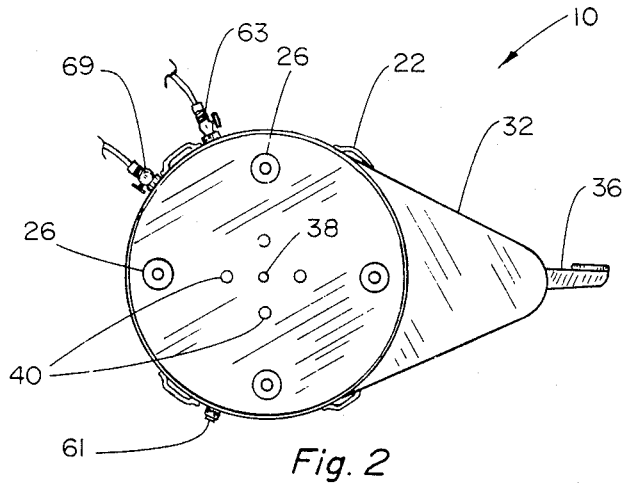
FIG. 2 is a top view of the golf club grip cleaning apparatus of FIG. 1.
Figure 1:
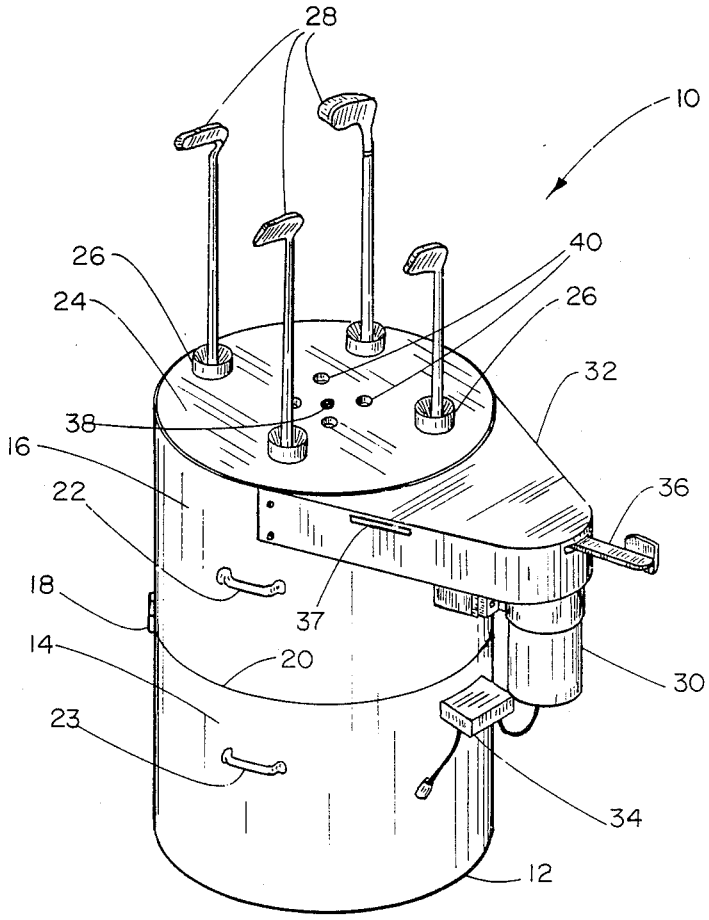
FIG. 1 is a perspective view of one particularly preferred embodiment of the golf club grip cleaning apparatus according to the present invention.

FIG. 1 illustrates the overall golf club grip cleaner according to the present invention, generally designated by the numeral 10. As illustrated in this particularly preferred embodiment, the grip cleaner comprises a closed housing member 12 made up of a lower compartment 14 and upper compartment 16 which can conveniently be removed by disengaging alignment pins and housings 18 (also see FIG. 2) along a seam 20 between the upper and lower compartments. To assist in the assembly and disassembly of the unit and the manual carrying of the device, handles 22 and 23 are provided on the outside of the unit (see FIGS. 2, 4 and 5). Handles 22 on the upper compartment 16 are used to lift the upper compartment 16 off of the lower compartment 14. Handles 22 and/or 23 can be used to carry or move the unit. As further illustrated in FIG. 1, the top of the cleaning unit 10 is a carousel-like lid 24 which has a plurality of funneled openings (four openings in this embodiment) positioned symmetrically about the outer portion of the lid and holding four golf clubs 28. Off to one side of the cleaning unit 10 is a drive motor 30 with drive belt shield 32 and electrical circuit 34 (partially illustrated). Extending from the furthest end of the drive belt shield 32 is a clutch pedal 36 that can be used by the operator to temporarily stop the rotation of the carousel 24 about central axis 38 thus interrupting the advancement of the golf clubs 28 through the wash and rinse cycles (as explained more fully later). The lid or carousel 24 is optionally provided with four additional finger holes 40 surrounding the central axis of rotation 38 such that during assembly and disassembly the carousel 24 can be manually withdrawn from or inserted into the upper compartment 16. The drive belt shield 32 is optionally equipped with additional slotted openings 37 that allow the clutch pedal to alternately extend out of the belt shield housing 32 in any of three selected directions.

Figure 3:
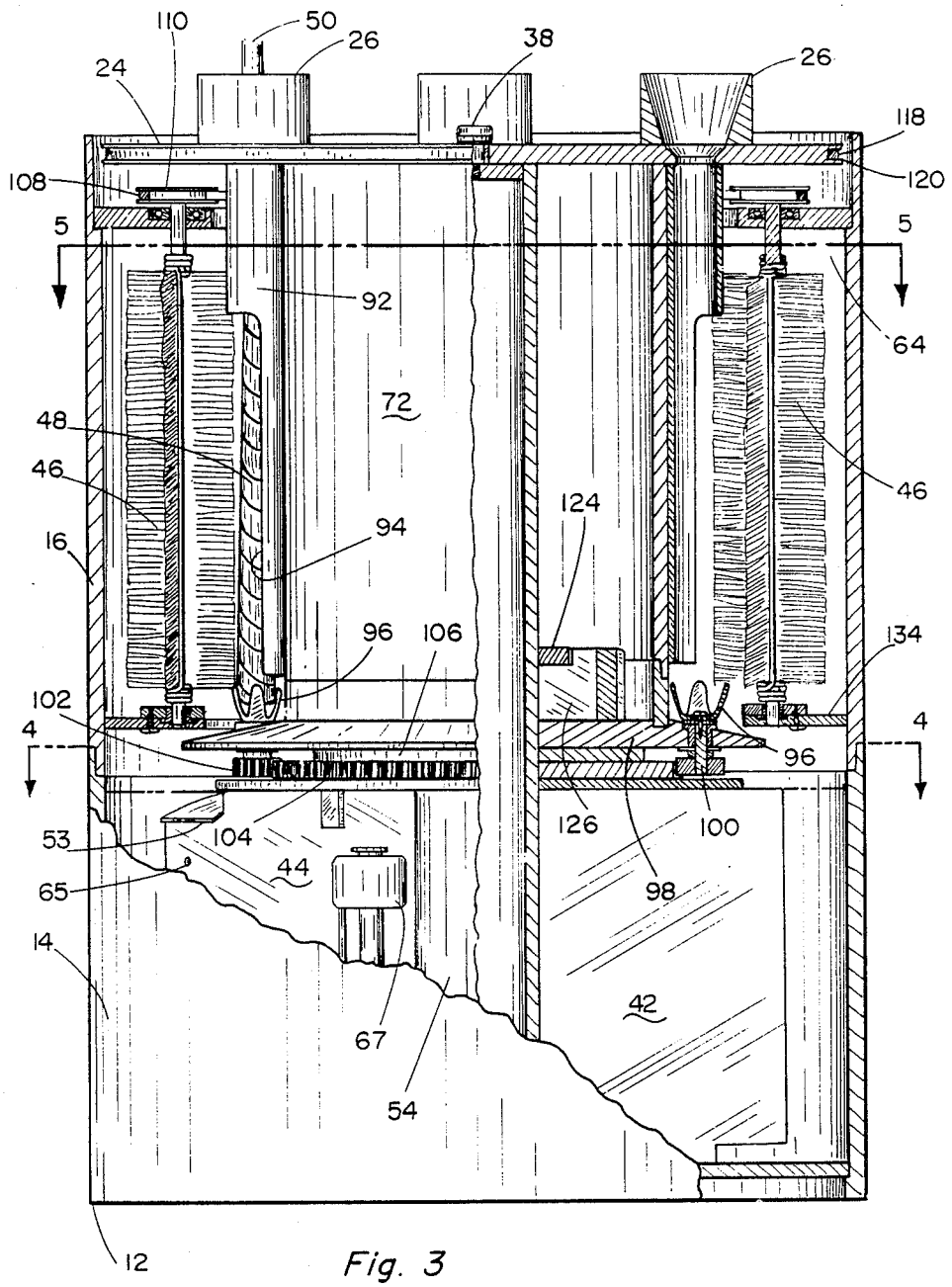
FIG. 3 is a partial cross-sectional side view of the wash/rinse housing of the golf club grip cleaning apparatus of FIG. 1 as seen through line 3—3, less the motor, drive belts and all but one golf club.

As illustrated in the cross-sectional side view of FIG. 3, the interior of the housing 12 consists of a lower partitioned compartment 14 containing a wash water reservoir 42 and a rinse water reservoir 44 and upper compartment 16 containing a plurality of scrub brushes 46. The carousel 24 also fits into the upper compartment 16 and acts as a fixture for holding and advancing the golf club grip 48 of the inverted golf club through the wash and rinse cycles in contact with the scrub brushes 46 while simultaneously spinning the golf club grip 48 about the club shaft 50.

Figure 4:
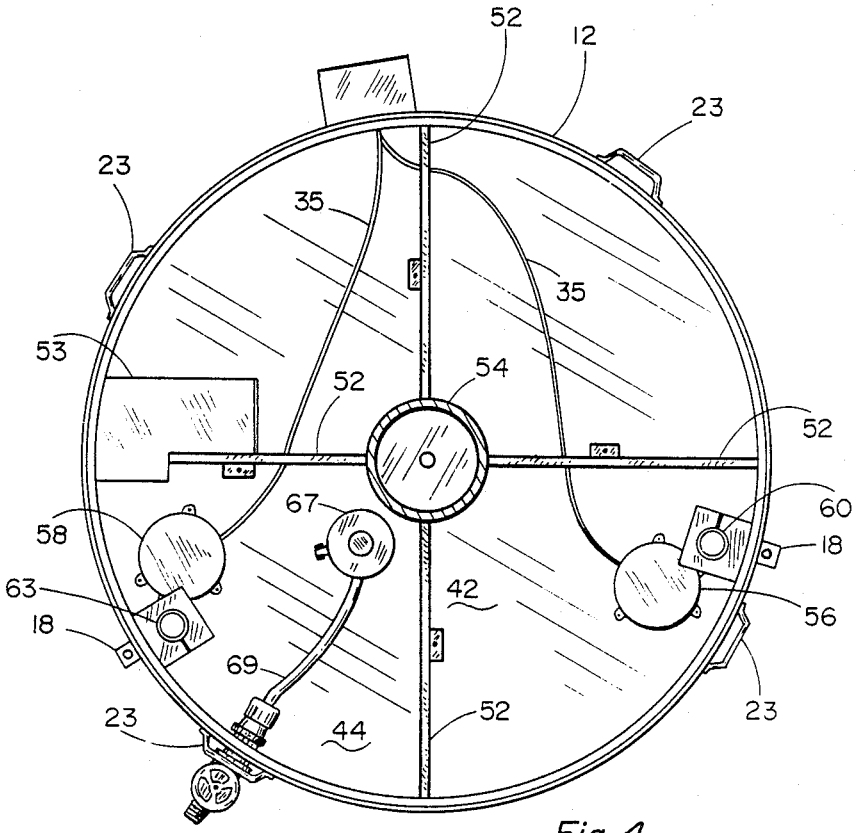
FIG. 4 is a partial cross-sectional top view of the lower portion of the wash/rinse housing of the golf club grip cleaning apparatus as seen through line 4–4 of FIG. 3.
Figure 8A:
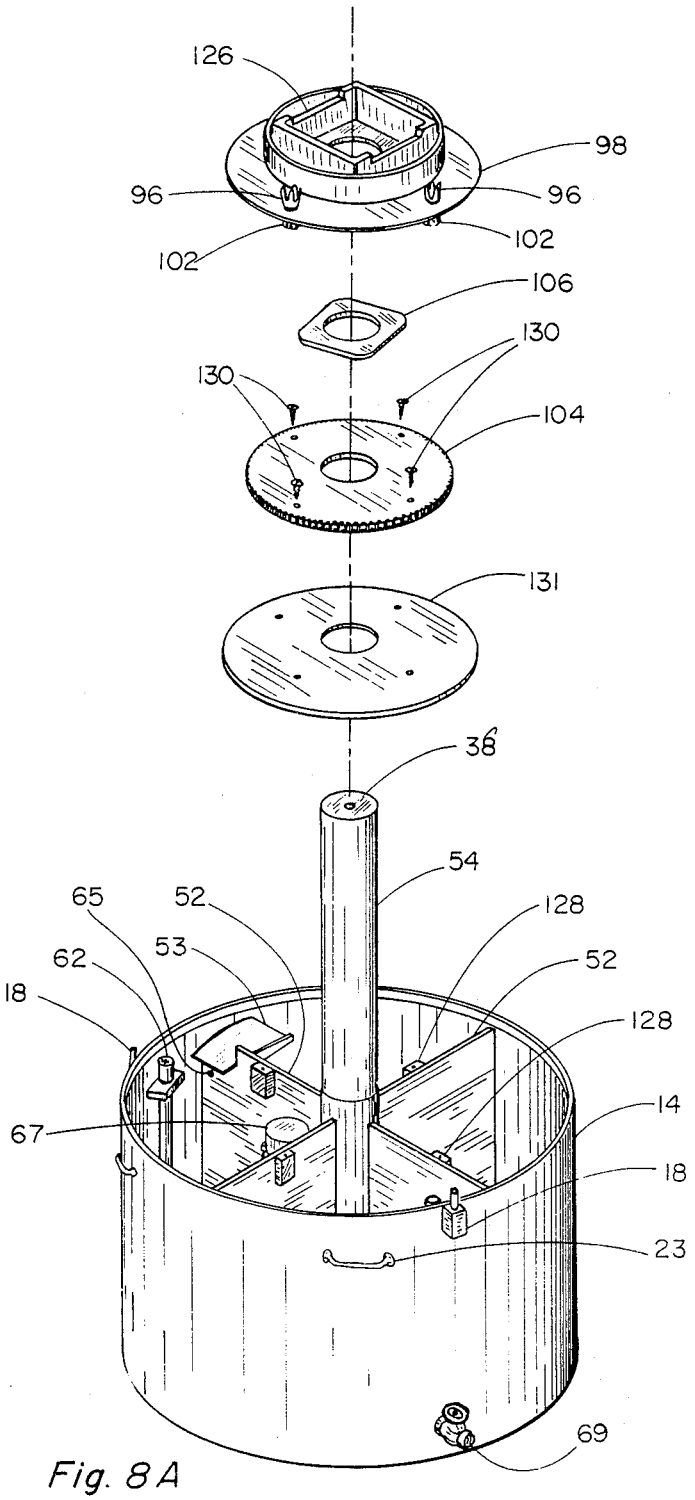
FIGS. 8A and 8B are a perspective view, with partial cross-sectioning, illustrating the sequential disassembled components of the wash/rinse housing of FIG. 3.

As seen in the cross-sectional top view of FIG. 4, the lower compartment 14 is conveniently partitioned into separate quadrants by internal vertical walls 52 that extend radially from a central hub and vertical axle 54 (see also FIG. 8A). The internal partitioned sidewalls 52 are used to establish a wash water reservoir 42 and a rinse water reservoir 44, each essentially isolated from the other and each containing a separate recirculating pump 56 and 58 with vertical water delivery tubes 60 and 62 and associated wiring 35. In the case of the wash water reservoir 42, the recirculating pump 56 delivers wash water through tube 60 to the wash zone 64 found in the upper compartment 16 (see FIG. 5). Similarly, the pump 58 of the rinse water reservoir recirculates rinse water from reservoir 44 through tube 62 to the rinse zone 66 in the upper compartment 16. Each tube 60 and 62 terminates at a nozzle 68 and 70 that direct a stream or spray of water between a pair of scrub brushes 46 located in the respective wash and rinse zones of compartment 16.

As seen in FIG. 3, the spray wash water and rinse water produced in the wash zone 64 and rinse zone 66 drain back to the wash reservoir 42 and rinse reservoir 44, respectively. To assist in directing the rinse water back into reservoir 66, the upper corner of one of the vertical radial walls 52 is notched and equipped with a slightly sloped splash drain 53. Advantageously, the individual quadrants partitioned off by radial walls 52 in the lower compartment 14 can be selectively allowed to be in fluid communication with each other by the presence of openings or the like, thus increasing the reservoir capacity for either the wash or rinse solutions. For example, three quadrants could be reserved for wash solution, thus reducing the frequency that the operator has to add make up detergent or soap, while the rinse quadrant could be continuously flushed with fresh water. To accomplish this and as illustrated in FIG. 4, the rinse water reservoir is equipped with a water level float assembly 67 that adds fresh water make up through water inlet line 69 as needed.

Simultaneously, the rinse water pump 58 and water delivery tube 52 is equipped with a water bleed outlet 63 (see FIG. 5) that during use directs a controlled slip stream of rinse water out of the unit, thus continuously replenishing the rinse water reservoir with fresh water. The vertical radial wall 52 containing the splash drain 53 is further equipped with a small opening 65 that allows rinse water to exit the rinse water reservoir 44 and enter the wash water reservoir 42, thus maintaining the liquid level in the wash water reservoir. To insure that the wash water reservoir 42 can be emptied, an optional plugged outlet 61 (see FIG. 5) is present in wash water delivery tube 62.

Figure 5:
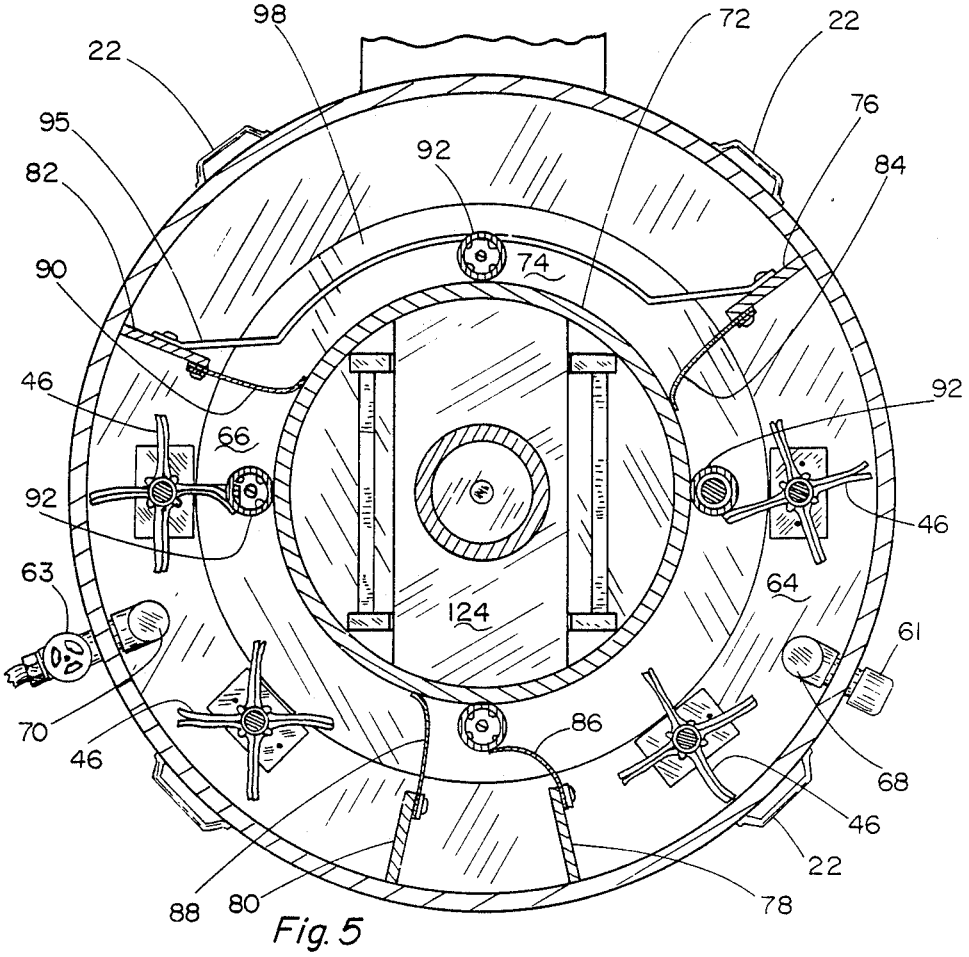
FIG. 5 is a partial cross-sectional top view of the upper portion of the wash/rinse housing of the golf club grip cleaning apparatus as seen through line 5—5 of FIG. 3.

As further seen in FIG. 3, the upper compartment 16 is covered by the carousel-like lid 24 which rests on top of the central axle 54 and revolves about central axis 38. On the underside of lid 24 extending vertically downward into the upper compartment 16 is a cylindrical sidewall member 72 that creates an annular space between the cylindrical sidewall 72 and outer sidewall of compartment 16. Within this annular space are the wash zone 64 and rinse zone 66 as well as a zone or region 74 for inserting and removing the inverted golf clubs. As seen in FIG. 5, the respective zones within upper compartment 16 are separated from each other by a series of radially extending, vertical partitions 76, 78, 80 and 82 attached to the inner surface of the outer sidewall of compartment 16. These partitions extend only partially across the annular space created between the inner member 72 and the outer surface of compartment 16, terminating such as to allow the golf club handle to rotate past the partition. Each partition 76, 78, 80 and 82 has a vertical flexible wiping surface member 84, 86, 88 and 90 attached to the outer edge which extend radially inward, making contact with the cylindrical inner sidewall member 72 of the carousel-like lid 24. Thus, partitions 76 and 78 with flexible wiping blades 84 and 86 define the wash zone 64, while partitions 80 and 82 with flexible wiping blades 88 and 90 define the rinse zone 66.

The region between partitions 76 and 72 represent the zone for inserting and withdrawing of the inverted golf clubs. The inverted golf club and handles are inserted through openings 26 in the carousel-like lid 24. Directly below the openings 26 are tubular members 92 which align and hold the golf club grip as it proceeds from the insertion stage through the wash and rinse stages and back to the withdrawal position. The lower outer portion of tubes 92 contain openings 94 (see FIGS. 3 and 8B) thus exposing the golf club grip to the water spray and scrub brushes 46 as the golf club proceeds through the wash zone 64 and rinse zone 66. The double partition 86 and 88 between the wash and rinse zones reduces the carry over of wash water into the rinse water reservoir. The inner bracket 95 located in the zone for insertion and removal of inverted golf clubs serve to reduce the size of the annulus and eliminate radial motion of the golf club during insertion. As such, the clubs will align with the rotatable receiving mechanisms 96 located at the base of the cylindrical sidewall member 72.

In the particularly preferred embodiment illustrated in FIGS. 1 through 8, the rotatable mechanism 96 receives the end of the golf club handle and shaft and under slight compression grips the handle and club such as to spin the club handle continuously as the carousel 24 rotates the club through the wash and rinse cycle. This is accomplished by virtue of each mechanism 96 being mounted through the rotatable water deflecting member 98 by use of an axle 100 about which the gripping mechanism 96 and held golf clubs spin and by virtue of a small gear 102 on the underside that is engaged to a larger stationary gear 104 attached to the lower compartment 14. Between the rotatable water deflector member 98 and the stationary larger gear 104 is a spacer 106 which also acts as a smooth bearing surface for the support and rotation of the water deflecting member 98 and load associated with the inserted golf clubs.

Figure 9:
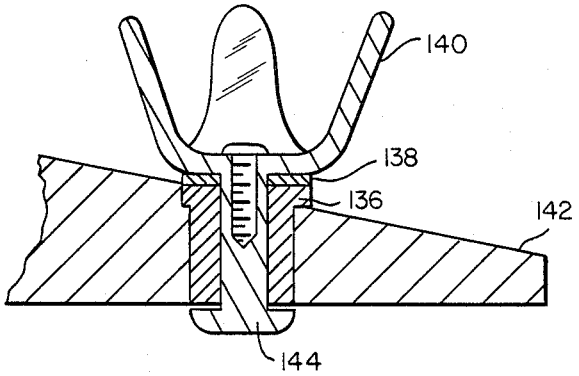
FIG. 9 is a partial cross-sectional view of an alternate embodiment of the golf club gripping mechanism illustrating a free rotation version driven by virtue of the golf club grip contacting the rotating scrub brushes.

FIG. 9 illustrates an alternate embodiment of the previously described rotatable mechanism 96, wherein a similar rotatable mechanism 140 is used to receive the end of the golf club handle and shaft and under slight compression grips the hand and club (not shown) such as to allow the club handle to spin freely when contacted by the spinning scrub brushes (again, not shown). In this freely rotating embodiment, the golf club gripping mechanism 140 is again mounted to the rotatable water deflecting member 142 by use of an axle 144 upon which the gripping mechanism 130 spins. However, in this embodiment, no small gear or large stationary gear (e.g., 102 and 104 of the previous embodiment) are present. Instead, the axle 144 spins freely within bushing 136 with the thrust washer 138 acting as a bearing surface. The entire impetus associated with the spinning of the golf club is associated continuous contact with the scrub brushes.

Figure 6:
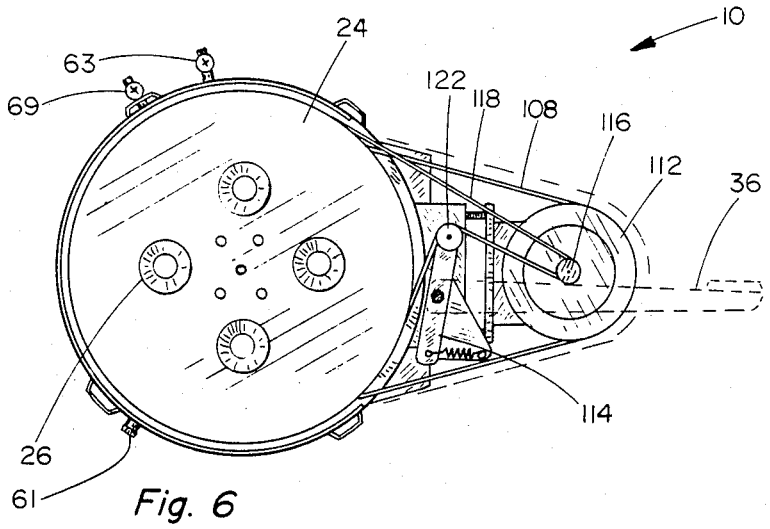
FIG. 6 is a top view of the golf club rotating mechanism within the wash/rinse housing of the golf club grip cleaning apparatus with the drive belt housing removed exposing the drive belt, clutch mechanism and motor assembly.
Figure 7:
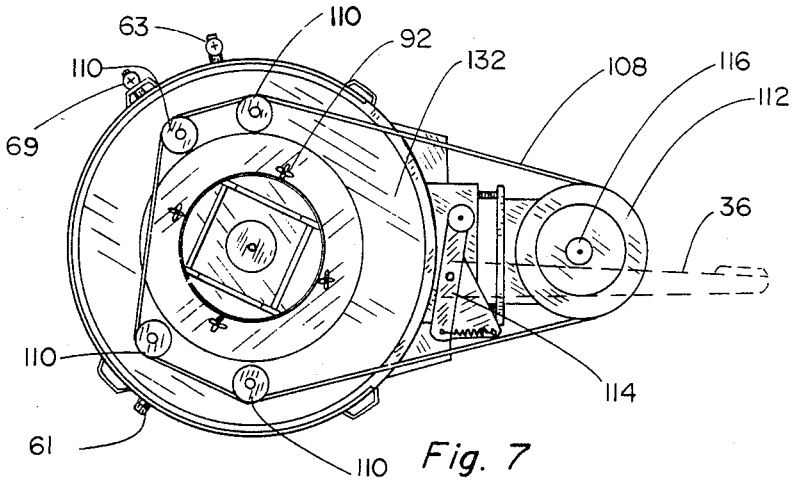
FIG. 7 is a top view of the brush drive mechanism within the wash/rinse housing of the golf club grip cleaning apparatus similar to FIG. 6 with the carousel-like golf club lid removed exposing the drive belt and motor assembly.

During operation of the golf club grip apparatus 10 according to the present invention, the scrub brushes 46 are driven by an electric motor 30 and drive belt 108 (see FIG. 7). In this particular embodiment, the scrub brush belt 108 passes directly through each of the pulleys 110 on the scrub brushes 46 and the motor driven pulley 112, thus spinning the scrub brushes continuously. In contrast, and as seen in FIG. 6, the rotation of the carousel-like lid 24 and inverted golf clubs can be interrupted by the operator by use of the manual clutch mechanism 114. Again, the electric motor 30 and motor driven pulley 116 are employed to drive belt 118 which passes around the upper outer grooved edge 120 of the carousel lid 24. The belt 118 also passes through tension pulley 122 of the clutch mechanism 114 in such a manner that when clutch lever arm 36 is depressed, tension on belt 118 is relaxed and the carousel 24 stops rotating. As such, the operator can temporarily stop the overall rotation of the inverted golf clubs when withdrawing or inserting a club, yet the cleaning action of the scrub brushes continues.

The rotational torque associated with the movement of the carousel lid 24 is transmitted to the wash deflecting member 98 located between the upper and lower compartments by the presence of the cogged interaction between cross member 124 attached to the inner, lower portion of cylindrical sidewall 72 and the slot 126 in housing 128 attached to the top of the water deflecting member 98 (see FIG. 8A). As seen in FIG. 3, the cross member 124 fits into the slot 126 and forces the carousel lid 24 and water deflecting member 98 to rotate as a single unit whenever drive belt 118 is in motion. This torque associated with the rotation of carousel lid 24 in the embodiment of FIGS. 1 through 8 (in contrast to the embodiment of FIG. 9) then converted into a spinning action by virtue of the interaction of the rotatable small gears 102 passing through the rotating water deflecting member 98 and engaged with the stationary larger gear 104, as previously indicated.

Figure 8B:
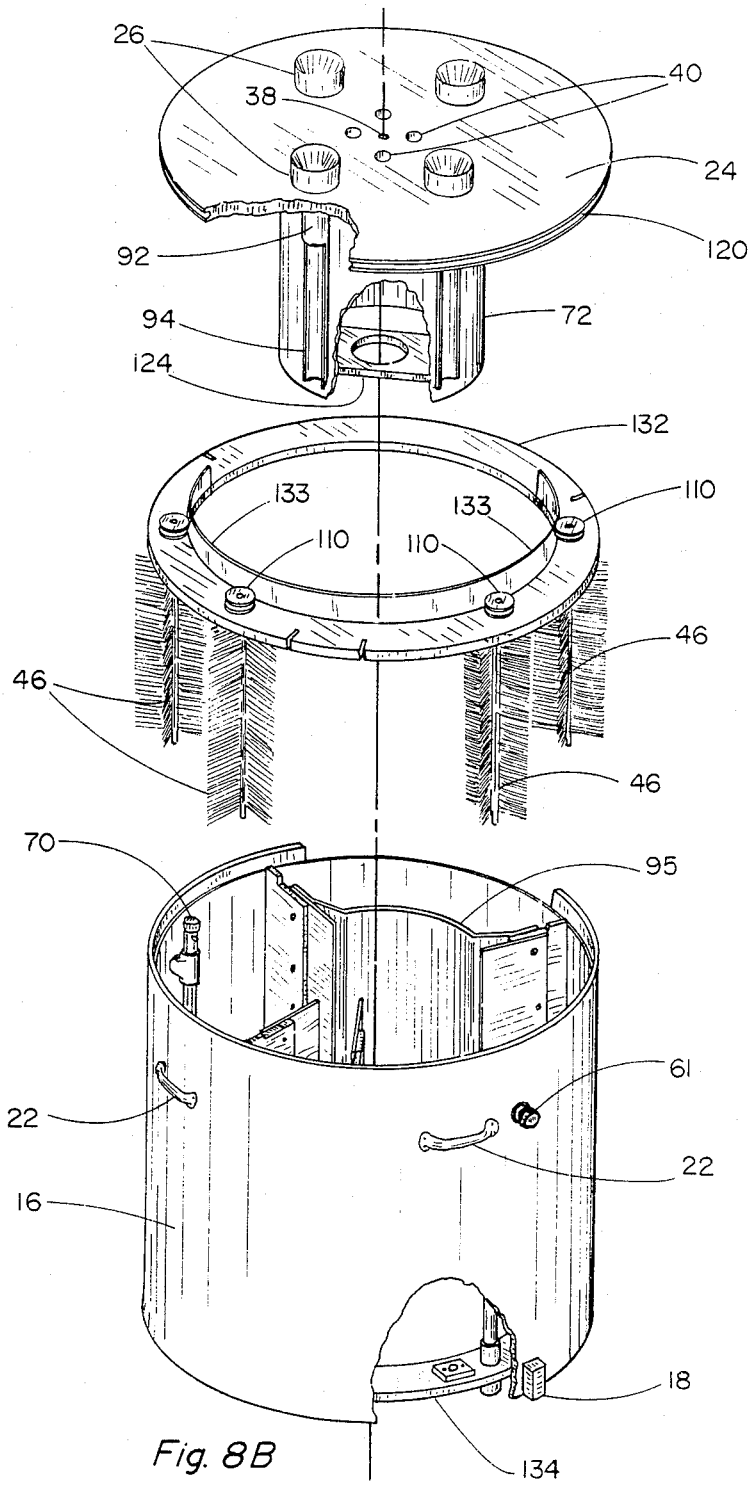

The composite of FIG. 8A and FIG. 8B illustrates how the overall golf club cleaner unit 10 is assembled and disassembled. As illustrated in FIG. 8A, the lower compartment 14 with internal partitioned walls 52 and central vertical axis 54 represents essentially a single component upon which the rest of the pieces and components are to be assembled. Located on the partitions 52 are four reinforcement screws 128 that receive screws 130 that attach the stationary gear 104 and gear support plate 131 to the top of the lower compartment 14 as a first stage of assembly. The bearing surface spacer 106 slips down the axle 54 which is then followed by the water deflector member 98. A slight rotation of member 98 as it is lowered will serve to engage the teeth of the small gears 102 with the larger gear 104. As seen in FIG. 8B, the upper compartment 16 with associated internal structure less lid 24 can then be placed on top of the assembled components illustrated in FIG. 8A as a single unit with the tongue and groove overlap of the compartments 14 and 16 creating the seam 20. During this stage of assembly, the upper and lower portions of the wash water tube 60 and rinse water tube 62 mate togther at seam 20, preferably by the use of an O-ring seal male to female connection or equivalent structure. The brush assembly 132 with optional water splash guard 133 can be lowered into the upper compartment 16 before or after the assembly of compartments 14 and 16 with the lower portion of the scrub brushes 46 being inserted into openings in the lower brush alignment bracket 134 circumferentially positioned around the lower, inner portion of the outer sidewall of compartment 16. At this stage of assembly, the brush drive belt 108 is installed (not shown). Gripping the lid 24 in finger holes 40 or elsewhere when finger holes are not employed, the carousel is lowered into the upper compartment until the cross member 124 comes to rest on housing 128. The belt 118 can then be installed (again, not shown) and a manual rotation of lid 24 of up to 180 degrees will aligne cross member 124 with slot 126 and complete the assembly process. Similarly, the unit 10 can be disassembled in reverse order with use of essentially minimum number of tools, effort and time.

The actual construction of the golf club cleaning apparatus according to the present invention can be from any material as generally known in the art and generally used for such purposes. Preferably, the unit is manufactured predominantly out of polyvinyl chloride and assembled by use of contemporary polymeric welding techniques and/or polymeric glues. It has been the present Inventor's experience that conventional extruded tubular PVC stock materials and flat PVC sheets can be readily employed in the present invention as the major structural components of the unit and can be readily fabricated by PVC welding techniques. The scrub brushes are preferably flat rubber sheets slit into individual strands that are folded and held by metal axis of rotation in water and/or corrosion resistant bearings. The bearing surface spacer is preferably polytheylene or similar material. The gears are preferably nylon or other water compatible materials with rubber being used as the flexible wiper surfaces and belts.

It should be appreciated that the wash reservoir and rinse reservoir could have nominal liquid volume retention and thus the apparatus can operate on an essentially continuous spraying of soap and rinse water followed by immediate draining (with or without recycle of water). Also, the number and location of brushes (if any) making contact with the golf club handles are considered arbitrary in that other mechanical scrubbing or even a sufficiently strong liquid spray could be used as an alternative to the scrub brushes illustrated in the preferred embodiment.

The golf club cleaning apparatus as illustrated in the drawings have been successfully tested on rubber handled golf clubs for a sustained period of time equivalent to cleaning the golf club handle once a day for ten years without deleterious effect on the club or club handle. The device has also repeatedly demonstrated the ability to clean a golf club handle in a single pass through the unit as well as supporting a continuous cleaning operation at a rate which is limited only by the operator's ability to insert and withdraw clubs manually.

Having thus described the invention with a certain degree of particularity, it is manifest that many changes can be made in the details of construction and the arrangement of components without departing from the spirit and scope of this disclosure. Therefore, it is to be understood that the invention is not limited to the embodiments set forth herein for purposes of exemplification, but is to be limited only by the scope of the attached claims, including a full range of equivalents to which each element thereof is entitled.

I claim:

1. An apparatus for cleaning a continuous sequence of golf club grips comprising:

(a) an essentially water tight, external housing member having an open top and an upper and lower compartment therein, wherein the upper compartment is partitioned into a golf club grip washing zone, a golf club grip rinse zone and a zone for insertion and removal of golf club grip and shaft and wherein the lower compartment is partitioned into a wash water reservoir and a rinse water reservoir;

(b) a rotatable, golf club positioning and advancing means for holding golf club grips and shafts of a plurality of inverted golf clubs inserted through a plurality of openings in the top of said golf club positioning and advancing means, within the upper compartment and for advancing golf club grips and shafts from the zone for insertion and removal sequentially through the wash zone and the rinse zone and back to the zone for insertion and removal;

(c) a rotatable, golf club spinning means adapted to be positioned between the upper and the lower compartments of said external housing member and rotate with said rotatable, golf club positioning and advancing means and for receiving and holding tips of inverted golf club grips and shafts and for allowing golf club grips and shafts being held within said upper compartment to spin by virtue of contact with rotatable scrubbing means as golf club grips and shafts advance through the wash zone and the rinse zone;

(d) a plurality of rotatable scrubbing means positioned within the upper compartment of said external housing member and adapted to make scrubbing contact with golf club grips as they advance from the insertion and removal zone through the wash zone and the rinse zone back to the insertion and removal zone;

(e) a motor powered means for driving said rotatable, golf positioning and advancing means;

(f) a recirculating pump and fluid delivery means for withdrawing water from the wash water reservoir and delivering said water to the wash zone; and (g) a recirculating pump and fluid delivery means for withdrawing water from the rinse water reservoir and delivering said water to the rinse zone.

2. An apparatus of claim 1 further comprising a manually operated clutch operatively engaged to said motor powered means for driving the rotatable golf club positioning and advancing means for selectively interrupting the power from said electric motor that drives the rotatable golf club positioning and advancing means.

3. An apparatus of claim 2 wherein said recirculating pump and fluid delivery means is further provided with a rinse water bleed-off means and fresh water make up means.

* * * * *